US012741310B2

(12) United States Patent
Noguchi

(10) Patent No.: US 12,741,310 B2
(45) Date of Patent: Sep. 22, 2026

(54) TOOL MOVING DEVICE AND WIRE FORMING MACHINE

(71) Applicant: ASAHI-SEIKI MANUFACTURING CO., LTD., Owariasahi (JP)

(72) Inventor: Yohei Noguchi, Tajimi (JP)

(73) Assignee: ASAHI-SEIKI MANUFACTURING CO., LTD., Owariasahi (JP)

( * ) Notice: Subject to any disclaimer, the term of this patent is extended or adjusted under 35 U.S.C. 154(b) by 342 days.

(21) Appl. No.: 18/707,040

(22) PCT Filed: Sep. 25, 2023

(86) PCT No.: PCT/JP2023/034696

§ 371 (c)(1),
(2) Date: May 2, 2024

(87) PCT Pub. No.: WO2024/247294

PCT Pub. Date: Dec. 5, 2024

(65) Prior Publication Data

US 2026/0158540 A1 Jun. 11, 2026

(30) Foreign Application Priority Data

May 30, 2023 (JP) ..... 2023-088583

(51) Int. Cl.
*B21F 1/00* (2006.01)
*B21F 3/08* (2006.01)
(Continued)

(52) U.S. Cl.
CPC ..... *B21F 3/08* (2013.01); *B21F 1/00* (2013.01); *B21F 3/04* (2013.01); *B21F 23/00* (2013.01); *B21F 35/00* (2013.01)

(58) Field of Classification Search
CPC ..... B21F 1/00; B21F 3/02
See application file for complete search history.

(56) References Cited

U.S. PATENT DOCUMENTS 5,875,666 A 3/1999 Itaya
6,393,888 B1 * 5/2002 Sautter ..... B21F 3/02 72/138

(Continued)

FOREIGN PATENT DOCUMENTS

EP 0950445 A2 * 10/1999 ..... B21F 3/02
JP H04-33436 U 3/1992

(Continued)

OTHER PUBLICATIONS

Nov. 11, 2025 Official Action in Mexican Patent Application No. MX/a/2024/006040.

(Continued)

*Primary Examiner* — Jared O Brown
(74) *Attorney, Agent, or Firm* — Oliff PLC

(57) ABSTRACT

A tool moving device includes: a slider link mechanism including a first drive source, a first link configured to be rotationally driven by the first drive source, a slide guide, a slider configured to be slidably supported by the slide guide, and a second link configured to be rotatably connected to the first link and the slider, the slider link mechanism being configured to be capable of moving the slider along the slide guide by power of the first drive source; a second drive source configured to be capable of rotationally driving the slide guide about a rotation axis parallel to a rotation axis of the first link; and a tool holder provided at a portion of the slider link mechanism, the portion being movable to any desired two-dimensional position by power of the first and second drive sources, and the tool holder being configured to hold a tool.

12 Claims, 8 Drawing Sheets

(51) Int. Cl.

| | |
|---|---|
| ***B21F 35/00*** | (2006.01) |
| *B21F 3/04* | (2006.01) |
| *B21F 23/00* | (2006.01) |

(56) References Cited

U.S. PATENT DOCUMENTS

| | | | | |
|---|---|---|---|---|
| 8,015,850 | B2 | 9/2011 | Tsuritani et al. | |
| 2007/0234773 | A1 | 10/2007 | Itaya | |
| 2008/0173056 | A1* | 7/2008 | Chang | B21F 35/02 72/137 |
| 2009/0120153 | A1 | 5/2009 | Itaya | |
| 2015/0040634 | A1 | 2/2015 | Costet | |
| 2022/0314301 | A1 | 10/2022 | Obayashi et al. | |

FOREIGN PATENT DOCUMENTS

| | | | |
|---|---|---|---|
| JP | H07-115101 | B2 | 12/1995 |
| JP | H09-253758 | A | 9/1997 |
| JP | H10-058075 | A | 3/1998 |
| JP | 2978075 | B2 | 11/1999 |
| JP | 2007-275942 | A | 10/2007 |
| JP | 2009-080386 | A | 4/2009 |
| JP | 4939202 | B2 | 5/2012 |
| JP | 2015-150583 | A | 8/2015 |
| JP | 2015-160220 | A | 9/2015 |
| JP | 2021-086973 | A | 6/2021 |
| JP | 2022-153842 | A | 10/2022 |
| WO | 2013/144477 | A1 | 10/2013 |

OTHER PUBLICATIONS

Apr. 8, 2025 Office Action issued in European Patent Application No. 23904770.7.

Dec. 5, 2023 International Search Report issued in International Patent Application No. PCT/JP2023/034696.

* cited by examiner

TOOL MOVING DEVICE AND WIRE FORMING MACHINE

TECHNICAL FIELD

The present disclosure relates to a tool moving device that transmits power from a drive source to a tool holder via a link mechanism, and a wire forming machine including such a tool moving device.

BACKGROUND ART

As this type of tool moving device, for example, a device including a slider link mechanism or a parallel link mechanism in which a tool holder performs a linear motion or a rotational motion is known (see, for example, Patent Document 1).

RELATED ART DOCUMENTS

Patent Documents

Patent Document 1: JP 2007-275942 A (paragraph [0006] and FIG. 10)

SUMMARY OF THE INVENTION

Problem to be Solved by the Invention

There is a demand for development of a technique capable of increasing the degree of freedom of the operation of the tool holder with respect to the conventional tool moving device described above.

Means of Solving the Problem

A tool moving device according to one aspect of the present disclosure includes: a slider link mechanism including a first drive source, a first link configured to be rotationally driven by the first drive source, a slide guide, a slider configured to be slidably supported by the slide guide, and a second link configured to be rotatably connected to the first link and the slider, the slider link mechanism being configured to be capable of moving the slider along the slide guide by power of the first drive source; a second drive source configured to be capable of rotationally driving the slide guide about a rotation axis parallel to a rotation axis of the first link; and a tool holder provided at a portion of the slider link mechanism, the portion being movable to any desired two-dimensional position by power of the first drive source and the second drive source, and the tool holder being configured to hold a tool.

MODE FOR CARRYING OUT THE INVENTION

First Embodiment

Figure 1:
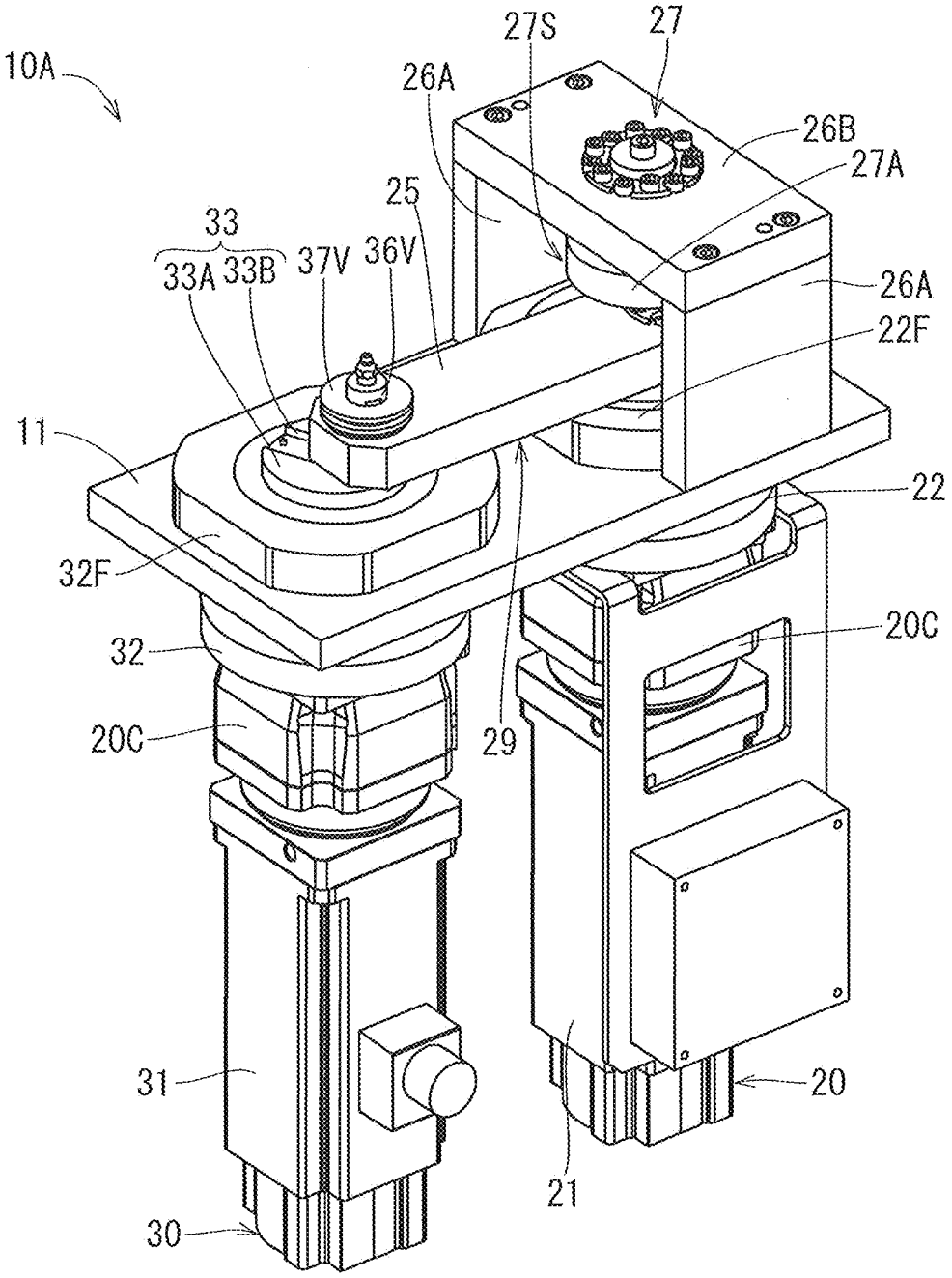
FIG. 1 is a perspective view of a tool moving device according to a first embodiment.

Hereinafter, a tool moving device 10A according to a first embodiment of the present disclosure will be described with reference to FIGS. 1 to 4. As illustrated in FIG. 1, the tool moving device 10A includes a first drive source unit 20, a second drive source unit 30, and a fixing base 11 to which the first drive source unit 20 and the second drive source unit 30 are fixed.

The first drive source unit 20 includes a first drive source 21 that is a servomotor, and a first speed reducer 22 that is disposed coaxially above the first drive source 21 and decelerates and outputs a rotational output of the first drive source 21. Similarly, the second drive source unit 30 includes a second drive source 31 that is a servomotor and a second speed reducer 32. Flanges 22F and 32F protrude laterally from upper portions of the side surfaces of the first and second speed reducers 22 and 32, respectively.

In the present embodiment, a relay box 20C for connecting an output unit of the first drive source 21 to an input unit of the first speed reducer 22 is provided between the first drive source 21 and the first speed reducer 22 in the first drive source unit 20. However, a structure may be employed in which the relay box 20C is not provided, an end surface of the first drive source 21 is stacked and fixed on an end surface of the first speed reducer 22, and the output unit of the first drive source 21 is connected to the input unit of the first speed reducer 22 while being received in the first speed reducer 22. The same applies to the second drive source unit 30. The first and second drive sources 21 and 31 are the same, and the first and second speed reducers 22 and 32 are the same, but they may be different. Furthermore, just one or neither of the first and second speed reducers 22 and 32 may be provided, and the output of one or both of the first and second drive sources 21 and 31 may be applied to a first link 23 and a slide guide 33 described later without being decelerated.

Figure 2:
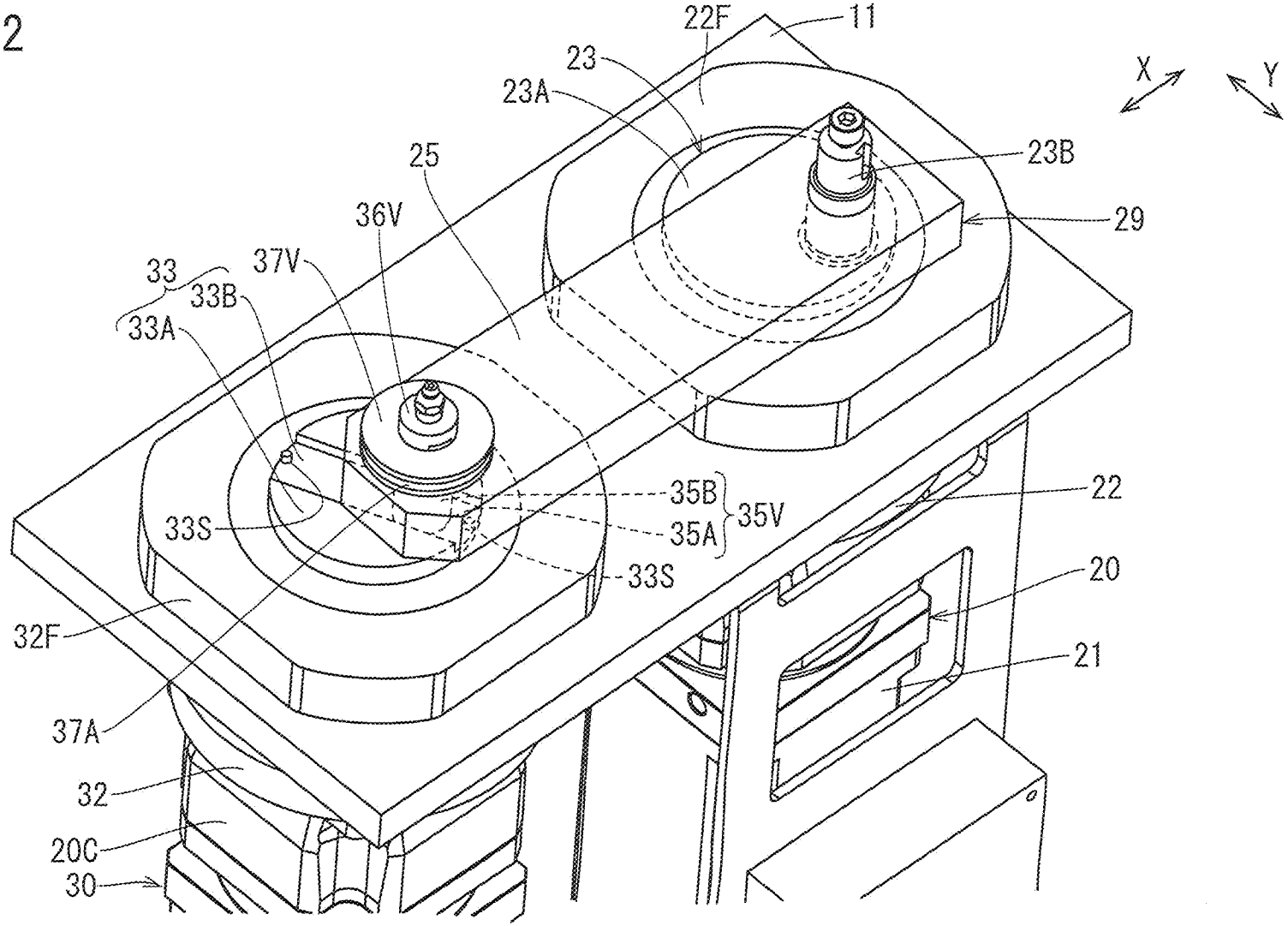
FIG. 2 is a perspective view of the tool moving device including a first slider.

As illustrated in FIG. 2, the fixing base 11 has a rectangular plate shape. In the fixing base 11, a pair of through holes (not illustrated) are provided side by side in the longitudinal direction. The first and second drive source units 20 and 30 are inserted into the pair of through holes from above, and the flanges 22F and 32F are stacked and fixed on an upper surface of the fixing base 11.

The first link 23 is fixed to an output unit (not illustrated) on an upper surface of the first speed reducer 22. The first link 23 has a structure in which a first shaft 23B stands up from a position away from the center of a disk portion 23A, and is rotationally driven about the center of the disk portion 23A serving as a rotation center.

A slide guide 33 is fixed to an output unit (not illustrated) on an upper surface of the second speed reducer 32. The slide guide 33 has a structure in which a guide groove 33B is provided on an upper surface of a disk portion 33A. The center of the guide groove 33B in the width direction and the longitudinal direction is disposed so as to coincide with the center of the disk portion 33A. The slide guide 33 is rotationally driven about the center of the disk portion 33A serving as a rotation center.

Although not illustrated in detail in the drawing, the guide groove 33B has, for example, a so-called dovetail groove structure in which the lower side is wider than the opening width of the upper end. A pair of stoppers 33S on which a slider 35V, 35W to be described later abuts are respectively provided at both ends in the longitudinal direction of the guide groove 33B.

In the present embodiment, the center of the guide groove 33B in the width direction and the longitudinal direction coincides with the rotation center of the slide guide 33, but this need not be the case. Specifically, the guide groove 33B may be disposed at an offset position so as not to include the rotation center of the slide guide 33, or the guide groove 33B may extend only in one direction instead of extending with an equal length in both directions from the rotation center of the slide guide 33. Although the pair of stoppers 33S are disposed in the guide groove 33B, the pair of stoppers may be disposed outside the guide groove 33B in the slide guide 33. More specifically, for example, the pair of stoppers 33S may be provided so as to protrude upward from the disk portion 33A of the slide guide 33, and the slider 35V, 35W to be described later may abut on them (see FIGS. 2 and 3A). Further, the pair of stoppers 33S need not be provided in the slide guide 33.

The slider 35V is slidably engaged with the slide guide 33. A lower portion of the slider 35V includes a slide engagement portion 35A slidably engaged with the guide groove 33B and a second shaft 35B extending upward from the slide engagement portion 35A.

Figure 3A:
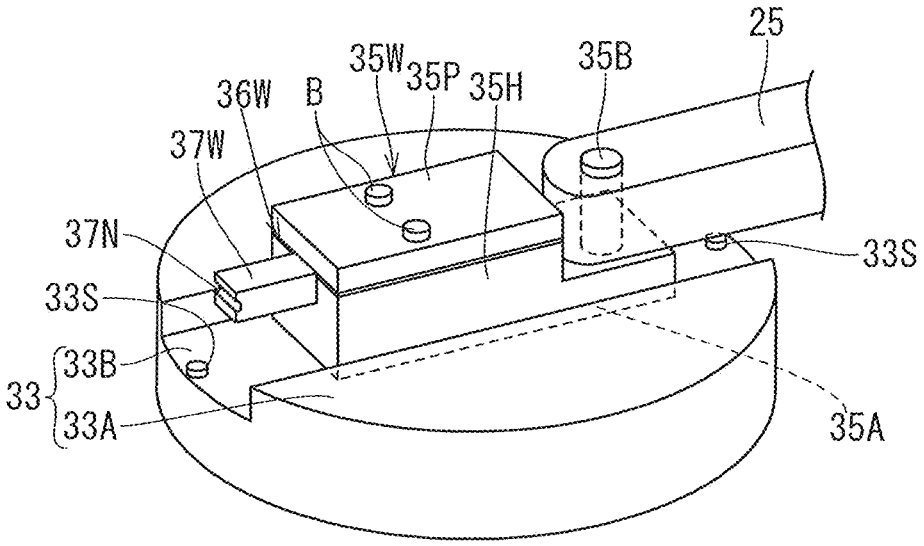
FIG. 3A is a perspective view of the tool moving device including a second slider.

FIG. 3A illustrates an example of the slider 35W different from the slider 35V described above. The slider 35W includes, for example, the slide engagement portion 35A that engages with the guide groove 33B on a lower surface of a block-shaped slider main body 35H extending in parallel with the slide guide 33. One end of the slider main body 35H in the longitudinal direction is lowered in a stepped manner, and the second shaft 35B protrudes upward from the one end. Hereinafter, only when the sliders 35V and 35W are distinguished, one is referred to as the "first slider 35V" and the other is referred to as the "second slider 35W".

In the present embodiment, the slide guide 33 includes the guide groove 33B to be engaged with the slide engaging portion 35A of the slider 35V, 35W. However, for example, the slide guide 33 may include a guide rail, and the slider 35V, 35W may include a slide engaging groove to be engaged with the guide rail. In addition, one bar having a non-circular cross section or a pair of bars extending in parallel may be provided in the slide guide 33 with both end portions supported, and an engagement hole through which such a bar passes may be provided in the slider 35V, 35W. Furthermore, in the present embodiment, the center of the second shaft 35B is disposed at the center of the guide groove 33B in the width direction, but may be disposed at a position shifted from the center of the guide groove 33B in the width direction.

As illustrated in FIGS. 2 and 3A, the first link 23 and the slider 35V, 35W are connected by a second link 25. The second link 25 extends in the horizontal direction and includes a pair of through holes at both ends, respectively. The first shaft 23B of the first link 23 and the second shaft 35B of the slider 35V, 35W pass through bearings (not illustrated) provided in that pair of through holes, and both ends of the second link 25 are rotatably connected respectively to the first link 23 and the slider 35V, 35W. As a result, a special slider link mechanism 29 including the first link 23, the second link 25, the slide guide 33, and the slider 35V, 35W is formed. The slide guide 33 is rotatable.

Figure 4A:
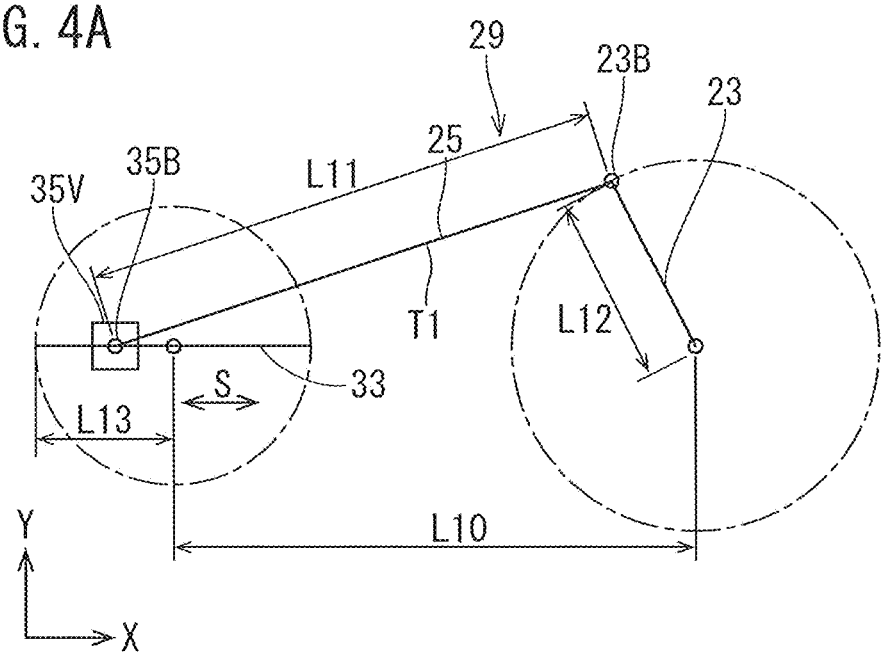
FIG. 4A is a conceptual diagram of a slider link mechanism in a state in which a slider is slidable.

In the present embodiment, as illustrated in FIG. 4A, an inter-axis distance L11 between the rotation center axis of the connecting portion of the first link 23 with the second link 25, and the rotation center axis of the connecting portion of the second link 25 with the slider 35V is different from an inter-axis distance L10 between the rotation center axis of the first link 23 and the rotation center axis of the slide guide 33, but the inter-axis distances L10 and L11 may be the same. In addition, in the present embodiment, an inter-axis distance L12 between the rotation center axis of the connecting portion of the first link 23 with the second link 25, and the rotation center axis of the first link 23, and an inter-axis distance L13 between the rotation center axis of the connecting portion of the second link 25 with the slider 35V and the rotation center of the slide guide 33 in a state where the slider 35V abuts on any one of the pair of stoppers 33S are different, but may be the same.

Furthermore, in the present embodiment, the second link 25 has a plate shape, but may have a rod shape. Furthermore, the second link 25 may extend straight as in the present embodiment or may be curved.

As illustrated in FIG. 2, in the first slider 35V, an upper portion of the second shaft 35B protrudes upward above the second link 25 to form a cylindrical tool holder 36V. The tool holder 36V rotatably holds, for example, a forming tool 37V having a roller shape. An annular groove 37A is formed on an outer peripheral surface of the forming tool 37V.

Figure 3B:
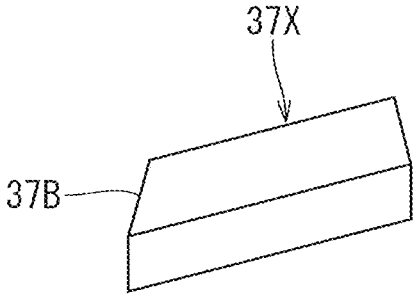
FIG. 3B is a perspective view of a cutting tool.

As illustrated in FIG. 3A, the second slider 35W includes a tool holder 36W at a position away from the second shaft 35B in the slider main body 35H. The tool holder 36W has a structure in which, for example, a prismatic tool is sandwiched between the slider main body 35H and a pressing plate 35P from the vertical direction and is tightened with a bolt B. Examples of the prismatic tool include a forming tool 37W having a groove 37N at a tip of a prismatic body, and a cutting tool 37X having a cutting blade 37B obtained by obliquely cutting a tip of a prismatic body as illustrated in FIG. 3B, for example.

As illustrated in FIG. 1, a pair of opposing walls 26A stand upright from the upper surface of the fixing base 11. The pair of opposing walls 26A face each other across the first speed reducer 22 in the width direction of the fixing base 11, and a ceiling wall 26B is stretched between upper ends of the pair of opposing walls 26A. A through hole (not illustrated) is formed coaxially with the rotation center of the first link 23 in the ceiling wall 26B, and an auxiliary link 27 is rotatably supported by a bearing (not illustrated) provided in the through hole.

The auxiliary link 27 includes a disk portion 27A having substantially the same outer diameter as that of the disk portion 23A of the first link 23 at a position below the ceiling wall 26B. A coupling hole (not illustrated) is formed at a position away from the rotation center in the disk portion 27A, and a portion of the first shaft 23B of the first link 23 protruding upward above the second link 25 is non-rotatably coupled to the coupling hole. As a result, a crank structural component 27S is formed of the first link 23 and the auxiliary link 27, and the crank structural component 27S is rotatably supported in a double-supported state.

Figure 4B:
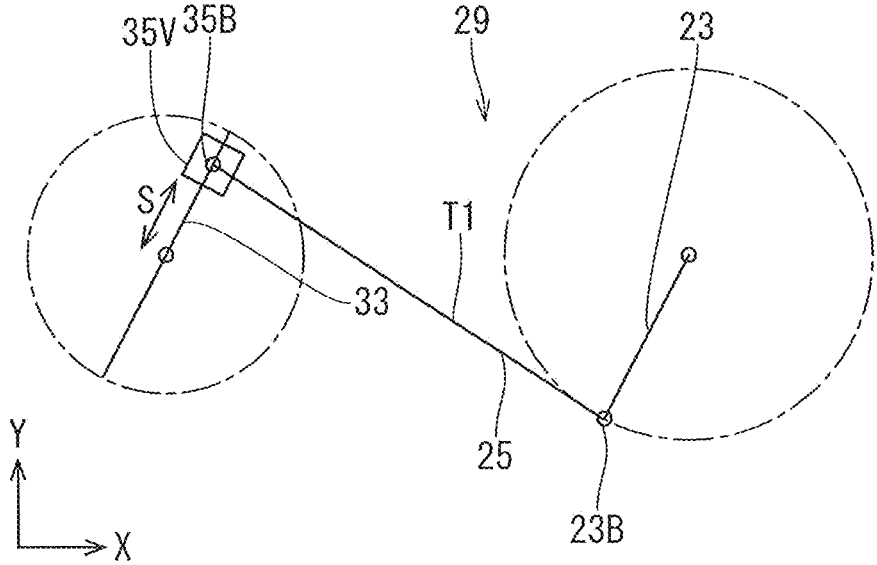
FIG. 4B is a conceptual diagram of the slider link mechanism in a state in which the slider is not slidable.

FIGS. 4A and 4B conceptually illustrate the special slider link mechanism 29 described above. Here, for convenience of description, a horizontal direction perpendicular to the rotation center axis of the first link 23 and the rotation center axis of the slide guide 33 will be referred to as an "X direction" (indicated by a reference sign"X" in the drawings), a horizontal direction perpendicular to the X direction will be referred to as a "Y direction" (indicated by a reference sign "Y" in the drawings), a horizontal direction in which the slider 35V, 35W is guided by the slide guide 33 (a direction in which the guide groove 33B extends) will be referred to as a "slide guide direction S", and a linear line segment perpendicular to the first and second shafts 23B and 35B will be referred to as a "relay line T1", and an example of the operation of the slider link mechanism 29 will be described.

As illustrated in FIG. 4A, when the slide guide 33 is non-rotatably locked by the second drive source 31 in a state where the slide guide direction S is parallel to the X direction, the slider link mechanism 29 functions as a general slider link mechanism, and can move the slider 35V to any desired slide position in the slide guide direction S by controlling the rotation position of the first link 23 by the first drive source 21. Even if the slide guide direction S is not parallel to the X direction, the tool holder 36V can be moved to any desired slide position by the first drive source 21 as long as the relay line T1 is not located at a singular point perpendicular to the slide guide direction S as illustrated in FIG. 4B. In addition, the slider 35V can be moved to any desired position around the rotation center of the slide guide 33 by the position control of the rotation position of the slide guide 33 by the second drive source 31. That is, by the control of the first drive source 21 and the second drive source 31, the slider 35V can be disposed at any desired position in a two-dimensional plane perpendicular to the rotation center axis of the slide guide 33, and can move so as to draw any desired trajectory in that two-dimensional plane. The same applies to the other slider 35W. The slider 35V, 35W includes the tool holder 36V, 36W, respectively.

As described above, in the tool moving device 10A of the present embodiment, the tool holder 36V, 36W is provided at the portion movable to any desired two-dimensional position by the power of the first drive source 21 and the second drive source 31 in the special slider link mechanism 29 driven by the power of the first drive source 21 and the second drive source 31, so that the degree of freedom of the operation of the tool holder 36V, 36W increases than that of the conventional device.

The special slider link mechanism 29 has a structure in which the second drive source 31 is added to a general slider link mechanism using the first drive source 21 as a drive source. However, it is not structured such that one of the first drive source 21 and the second drive source 31 is mounted on a portion driven by the other, so that a decrease in acceleration of the operation of the tool holder 36V, 36W due to an increase in weight by the second drive source 31 is suppressed. Furthermore, depending on the operation, the tool holder 36V, 36W can be operated using the power of both the first drive source 21 and the second drive source 31, whereby the acceleration of the operation can be increased as compared with the conventional case, or the pressing force on a workpiece can be increased as compared with the conventional case.

Furthermore, the tool holder 36V, 36W may be provided on the slider 35V, 35W, or may be provided on the second link 25 as long as it is a portion movable to any desired two-dimensional positions by the first drive source 21 and the second drive source 31. However, in the tool moving device 10A having the first slider 35V, the tool holder 36V is disposed coaxially with the rotation center of the portion rotatably connecting the slider 35V and the second link 25, so that the structure of the tool moving device 10A is simplified.

In addition, since the tool moving device 10A of the present embodiment includes the first drive source unit 20 and the second drive source unit 30 arranged in the X direction, the tool moving device 10A becomes compact in the X direction and the Y direction perpendicular thereto. As a result, it is possible to reduce an installation space when a plurality of the tool moving devices 10A are arranged in the Y direction.

In addition, in the tool moving device 10A including the first slider 35V, since the forming tool 37V has a roller shape and is rotatably held by the tool holder 36V, there is no restriction that the forming tool 37V needs to be oriented in a predetermined direction when the forming tool 37V moves, and the operation setting (for example, teaching processing) of the forming tool 37V can be easily performed.

Second Embodiment

Figure 5:
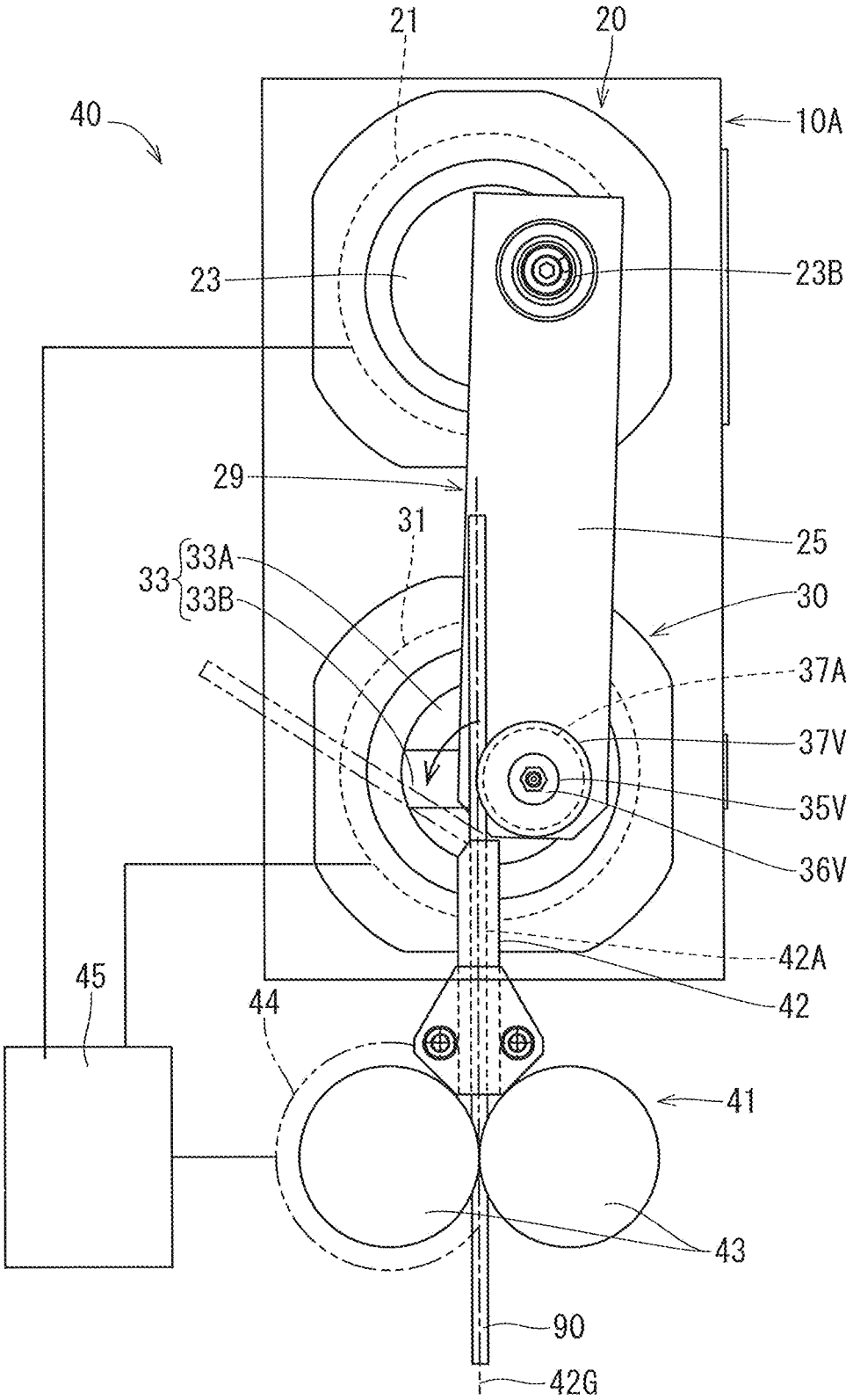
FIG. 5 is a plan view of a wire forming machine according to a second embodiment.
Figure 6A:
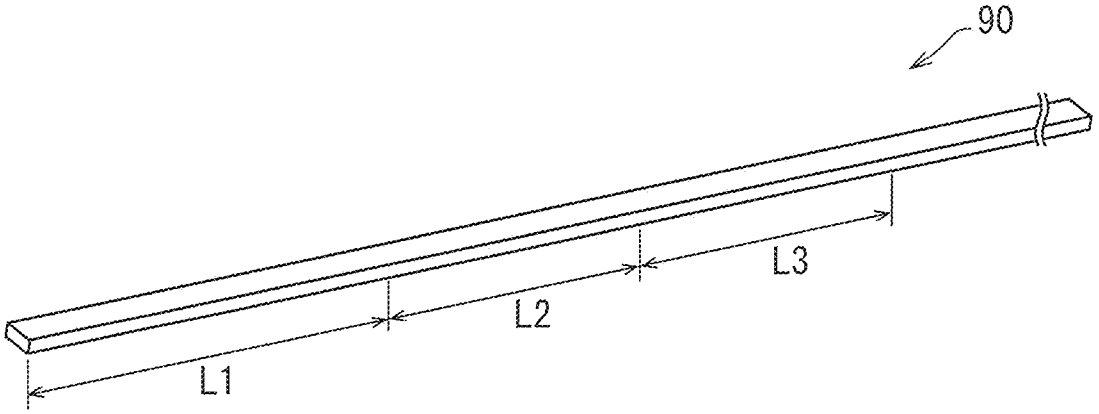
FIG. 6A is a perspective view of a wire having a certain length before being formed into a U-shaped body.
Figure 6B:
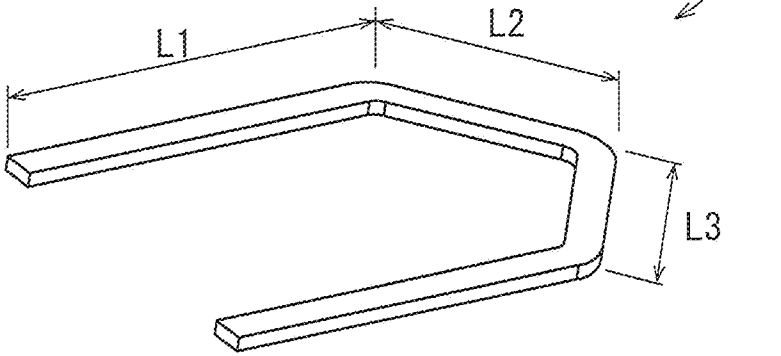
FIG. 6B is a perspective view of the U-shaped body.

Hereinafter, a wire forming machine 40 according to a second embodiment of the present disclosure will be described with reference to FIGS. 5 to 7. As illustrated in FIG. 5, the wire forming machine 40 includes the tool moving device 10A described in the first embodiment, a wire feeding device 41, and a control unit 45 that controls the tool moving device 10A and the wire feeding device 41. A wire 90 illustrated in FIG. 6A is bent and formed into a U-shaped body 91 (it is generally called a "segment coil") illustrated in FIG. 6B, which will be a part of a coil of a motor. The wire 90 has a quadrangular cross section.

Specifically, the wire feeding device 41 includes a quill 42 having a wire guide hole 42A having a quadrangular cross section through which the wire 90 can pass, a pair or a plurality of pairs of feeding rollers 43 that are symmetrically arranged with respect to a wire feeding line 42G extending along the wire guide hole 42A and that rotate symmetrically, and a third drive source 44 that is a servomotor for driving the feeding rollers 43. A plurality of wires 90 which have been cut into a certain length in advance are sequentially supplied to the wire feeding device 41. Then, the wire feeding device 41 feeds the plurality of wires 90 one by one toward the wire guide hole 42A of the quill 42 by the feeding rollers 43. Each of the wires 90 separated from the feeding rollers 43 is pushed by the next wire 90 fed by the feeding rollers 43 and fed to a position separated from the quill 42.

The tool moving device 10A of the present embodiment includes the first slider 35V described in the first embodiment, and holds the forming tool 37V having a roller shape. The annular groove 37A of the forming tool 37V has a square groove shape in which the wire 90 just fits. In the tool moving device 10A, the first drive source unit 20 and the second drive source unit 30 are arranged in a direction parallel to the wire feeding line 42G, and the second drive source unit 30 is located on the quill 42 side. The annular groove 37A of the forming tool 37V is arranged at the same height as the wire guide hole 42A of the quill 42. The first drive source 21, the second drive source 31, and the third drive source 44 are controlled by the control unit 45 such that the tool moving device 10A operates to form the wire 90 into the U-shaped body 91 as follows.

Specifically, the wire feeding device 41 of the wire forming machine 40 is controlled such that the wire 90 is fed from a tip of the quill 42 by prescribed lengths L1, L2, and L3 illustrated in FIG. 6 and is stopped each time. While the wire feeding device 41 is stopped, the forming tool 37V moves so as to press a portion of the wire 90 extending straight from the tip of the quill 42 from the side, and a plurality of portions of the wire 90 are bent to form the U-shaped body 91. Examples of the operation of the forming tool 37V include the patterns of FIGS. 7A and 7B.

Figure 7A:
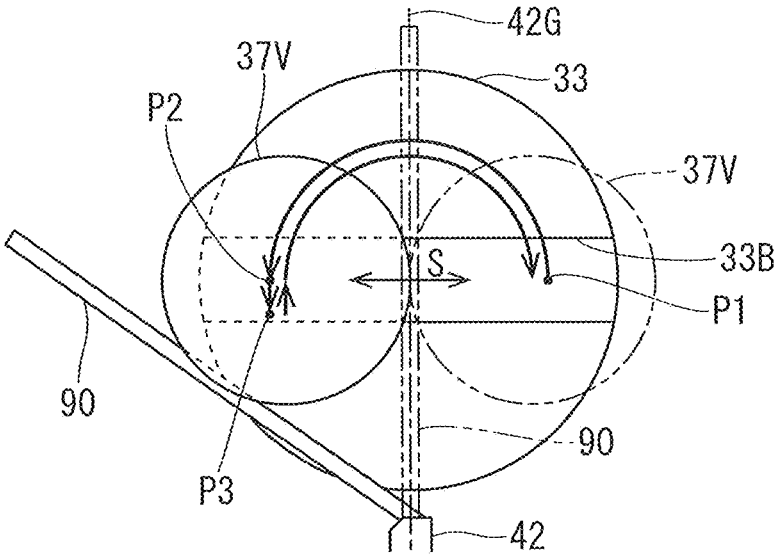
FIG. 7A is a conceptual diagram of a trajectory pattern of the tool holder.

In the pattern of FIG. 7A, for example, when the forming tool 37V waits for the wire 90 to be fed from the quill 42 at a first position P1 where the slide guide direction S is substantially perpendicular to the wire feeding line 42G and the forming tool 37V is disposed on one side (right side in FIG. 7A) with respect to the wire feeding line 42G, and the wire 90 is fed by a predetermined length and stopped (state indicated by two-dot chain line in FIG. 7A). Then, for example, the slide guide 33 rotates by 180 degrees, and the forming tool 37V moves to a second position P2 while drawing an arc so as to be separated from the quill 42. As a result, the portion of the wire 90 having been fed from the quill 42 is bent with respect to the portion remaining in the quill 42. The slide guide 33 rotates by a predetermined amount so that the forming tool 37V further presses the wire 90 considering the spring back of the wire 90, and the forming tool 37V moves from the second position P2 to a third position P3. Then, a reverse operation to the operation so far is performed, and the forming tool 37V returns from the third position P3 to the first position P1. Although the operation of the forming tool 37V in this pattern is an operation of only reciprocating in an arc trajectory, and can be realized only by fixing the slider 35V (see FIG. 5) to the slide guide 33 and rotationally driving it by the second drive source 31, the forming tool 37V can be pressed against the wire 90 by the resultant force of the second drive source 31 and the first drive source 21. As a result, a load on each of the second drive source 31 and the first drive source 21 is suppressed, and occurrence of a defect such as overheating is prevented.

Figure 7B:
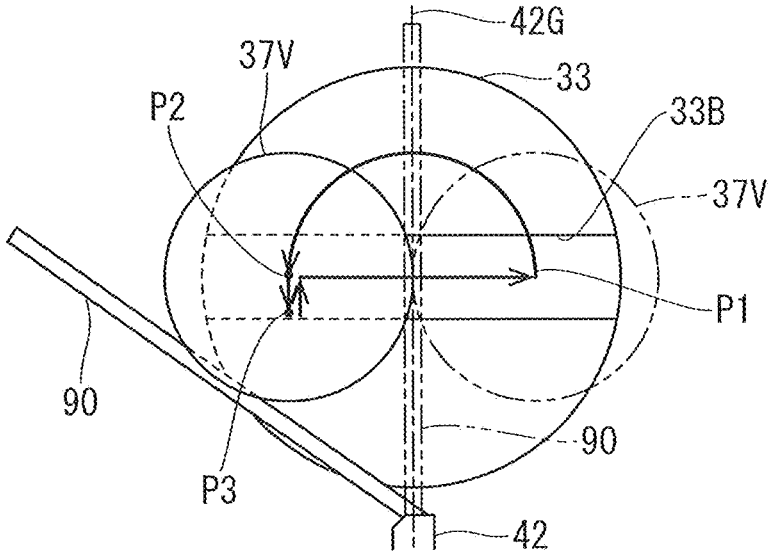
FIG. 7B is a conceptual diagram of another trajectory pattern of the tool holder.

In the pattern of FIG. 7B, the operation until the forming tool 37V moves to the first position P1, the second position P2, and the third position P3 and returns to the second position P2 is the same as the pattern of FIG. 7A described above. Thereafter, in a state where the slide guide 33 is stopped, the forming tool 37V slides along the guide groove 33B of the slide guide 33 by the first drive source 21 and returns to the first position P1. Also in this pattern, an effect similar to that of the pattern of FIG. 7A is obtained, and the movement trajectory of the forming tool 37V is shortened to shorten the operation time.

As described above, according to the wire forming machine 40 of the present embodiment, the degree of freedom in forming the U-shaped body 91 is increased, and the U-shaped body 91 can be formed in an aspect different from the conventional device by including the tool moving device 10A described in the first embodiment.

Third Embodiment

Figure 8:
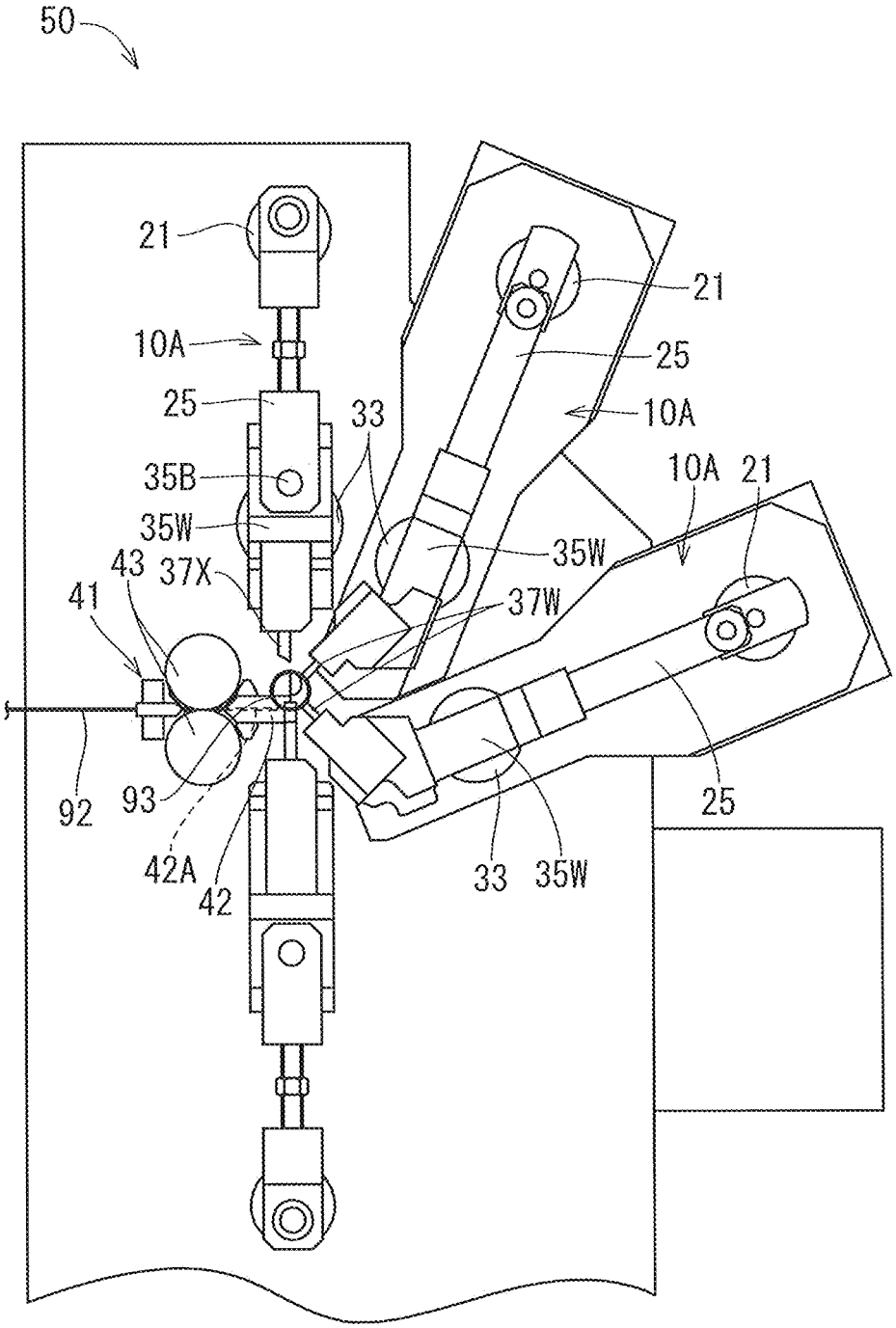
FIG. 8 is a plan view of a wire forming machine according to a third embodiment.

Hereinafter, a wire forming machine 50 according to a third embodiment of the present disclosure will be described with reference to FIG. 8. The wire forming machine 50 forms a coil spring 93 from a wire 92, and for this purpose, for example, includes a total of three tool moving devices 10A including two tool moving devices 10A each having the second slider 35W described in the first embodiment and holding the forming tool 37W and one tool moving device 10A having the second slider 35W and holding the cutting tool 37X. The basic structure of the wire forming machine 50 other than the structures of the tool moving devices 10A is the same as that described in, for example, JP 2015-150583 A and JP 2022-153842 A.

In the wire forming machine 50, for example, in the tool moving device 10A that holds the cutting tool 37X, the slider 35W is slid along the guide groove 33B (see FIG. 3A) while the slide guide 33 is reciprocated at a predetermined angle, so that a cutting edge of the cutting tool 37X can be operated to draw an arc trajectory. As a result, burrs can be reduced as compared with the conventional case.

Further, for example, in the forming tool 37W, by appropriately changing the rotation position of the slide guide 33, it is possible to appropriately change the angle of the surface of the forming tool 37W that abuts on the wire. It becomes possible to easily perform adjustment that has been conventionally performed only by changing the attachment posture of the forming tool 37W with respect to the tool holder 36W.

OTHER EMBODIMENTS

In the tool moving device 10A of the above embodiments, the tool holder 36V, 36W is included in the slider 35V, 35W, but for example, the tool holder 36V, 36W may be provided at a position near the slider 35V, 35W in the second link 25. In other words, as long as the tool holder can be disposed at any desired position in the two-dimensional plane in the special slider link mechanism 29 by the control of the first drive source 21 and the second drive source 31, the same effects as those of the first embodiment described above can be obtained regardless of the position of the tool holder in the special slider link mechanism 29.

In the tool moving device 10A of the above embodiments, the slide guide 33 is fixed to the output unit of the second speed reducer 32 of the second drive source unit 30. However, for example, the slide guide 33 may be rotatably supported by the fixing base 11, and the second drive source 31 serving as a power source of the slide guide 33 may be disposed at a position different from the position which is coaxial with the slide guide 33 and connected to the slide guide 33 by a gear, a link, or the like. The same applies to the first drive source unit 20.

In the tool moving device 10A of the above embodiments, both the first drive source 21 and the second drive source 31 are servo motors. However, for example, the second drive source 31 may be an air motor or a hydraulic motor, and may include a first stopper that abuts when the slide guide 33 rotates in one direction and is disposed at a first rotation position, and a second stopper that abuts when the slide guide 33 rotates in the other direction and is disposed at a second rotation position. In addition, the second drive source 31 may include a hydraulic cylinder or an air cylinder instead of a motor, and form a similar configuration. In such a configuration, although the slide guide 33 can be changed only by the second drive source 31 at two positions of the first rotation position and the second rotation position, the tool holder 36V, 36W is disposed at any desired two-dimensional position by combining a desired sliding position controlled by the first drive source 21.

Supplementary Note

Hereinafter, feature groups according to the present disclosure including features extracted from the above-described embodiments will be described while showing effects and the like as necessary. Note that, in the following, for easy understanding, reference signs of corresponding configurations in the above embodiments are indicated in parentheses, but these feature groups are not limited to the configurations of the reference signs indicated in the parentheses.

Feature 1

A tool moving device (10A) including: a slider link mechanism (29) including a first drive source (21), a first link (23) configured to be rotationally driven by the first drive source (21), a slide guide (33), a slider (35V, 35W) configured to be slidably supported by the slide guide (33), and a second link (25) configured to be rotatably connected to the first link (23) and the slider (35V, 35W), the slider link mechanism (29) being configured to be capable of moving the slider (35V, 35W) along the slide guide (33) by power of the first drive source (21); a second drive source (31) configured to be capable of rotationally driving the slide guide (33) about a rotation axis parallel to a rotation axis of the first link (23); and a tool holder (36V, 36W) provided at a portion of the slider link mechanism (29), the portion being movable to any desired two-dimensional position by power of the first drive source (21) and the second drive source (31), and the tool holder (36V, 36W) being configured to hold a tool (37V, 37W, 37X).

The tool moving device of Feature 1 includes a special slider link mechanism in which the slider slides along the slide guide by the power of the first drive source and the slide guide is rotationally driven by the power of the second drive source. The tool holder is provided at the portion movable to any desired two-dimensional position by the power of the first drive source and the second drive source in the special slider link mechanism, so that the degree of freedom of the operation of the tool holder increases than that of the conventional device. In addition, the special slider link mechanism has a structure in which the second drive source is added to a general slider link mechanism using the first drive source as a drive source, but is not structured such that one of the first drive source and the second drive source is mounted on a portion driven by the other, so that a decrease in acceleration of the operation of the tool holder due to an increase in weight by the second drive source is suppressed. Furthermore, depending on the operation, the tool holder can be operated using the power of both the first drive source and the second drive source, whereby the acceleration of the operation can be increased as compared with the conventional case, or the pressing force on a workpiece can be increased as compared with the conventional case.

Feature 2

The tool moving device (10A) according to Feature 1, including: a first speed reducer (22) disposed coaxially with the first drive source (21) and configured to decelerate and output a rotational output received from the first drive source (21); a second speed reducer (32) disposed coaxially with the second drive source (31) and configured to decelerate and output a rotational output received from the second drive source (31); and a fixing base (11) fixing the first speed reducer (22) and the second speed reducer (32) so as to be arranged in parallel, in which the first link (23) is fixed to an output unit of the first speed reducer (22), and the slide guide (33) is fixed to an output unit of the second speed reducer (32).

The tool moving device of Feature 2 is downsized in a direction (hereinafter, referred to as "lateral direction") perpendicular to the direction in which the first speed reducer and the second speed reducer are arranged. As a result, it is possible to reduce an installation space when a plurality of the tool moving devices are arranged in the lateral direction.

Feature 3

The tool moving device (10A) according to Feature 1 or 2, in which the tool holder (36V) is configured to hold the tool (37V) having a roller shape so as to be rotatable about a rotation axis parallel to the rotation axis of the first link (23).

In the tool moving device of Feature 3, since the tool has the roller shape and is rotatably held by the tool holder, there is no restriction that the tool needs to be oriented in a predetermined direction, and the operation setting (for example, teaching processing) of the tool can be easily performed.

Feature 4

The tool moving device (10A) according to Feature 3, in which the tool holder (36V) is disposed coaxially with a rotation center of a portion rotatably connecting the slider (35V) and the second link (25).

The tool holder may be provided on the slider, or may be provided on the second link as long as the tool holder is movable to any desired two-dimensional position by the first drive source and the second drive source. However, as in the tool moving device of Feature 4, if the tool holder is disposed coaxially with the rotation center of the portion which rotatably connects the slider and the second link, the structure of the tool moving device is simplified.

Feature 5

A wire forming machine (40) configured to bend a linear wire (90) having a certain length to form a U-shaped body (91) that becomes a part of a coil of a motor, the wire forming machine (40) including: the tool moving device (10A) according to any one of Features 1 to 4; a wire feeding device (41) including a quill (42) configured to guide the wire (90), the wire feeding device being configured to be capable of feeding the wire (90) from a tip of the quill (42) in a direction perpendicular to the rotation axis of the first link (23); and a control unit (45) configured to control the first drive source (21) and the second drive source (31) in order for the tool (37V) to press and bend the wire (90) extending from the tip of the quill (42) from a side.

Since the wire forming machine of Feature 5 includes the tool moving device described above, the degree of freedom in forming the U-shaped body is increased, and the U-shaped body can be formed in an aspect different from the conventional device.

Note that, although specific examples of the technique included in the claims are disclosed in the present specification and the drawings, the technique described in the claims is not limited to these specific examples, and includes those obtained by variously modifying and changing the specific examples, and also includes those obtained by singly extracting a part from the specific examples.

DESCRIPTION OF REFERENCE NUMERAL

10A tool moving device
11 fixing base
21 first drive source
22 first speed reducer
23 first link
25 second link
29 slider link mechanism
31 second drive source
32 second speed reducer
33 slide guide
35V, 35W slider
36V, 36W tool holder
37A annular groove
37V, 37W forming tool
37X cutting tool
40, 50 wire forming machine

41 wire feeding device
42 quill
44 third drive source
45 control unit
90 wire
91 U-shaped body

The invention claimed is:

1. A tool moving device comprising:

a slider link mechanism including a first drive source, a first link configured to be rotationally driven by the first drive source, a slide guide, a slider configured to be slidably supported by the slide guide, and a second link rotatably and directly connected to the first link and the slider, the slider link mechanism being configured to move the slider along the slide guide by power of the first drive source;

a second drive source configured to rotationally drive the slide guide about a rotation axis parallel to a rotation axis of the first link; and a tool holder provided at a portion of the slider link mechanism on the slider or on the second link, the portion being movable to a plurality of two-dimensional positions by power of the first drive source and the second drive source, and the tool holder being configured to hold a tool.

2. The tool moving device according to claim 1, comprising:

a first speed reducer disposed coaxially with the first drive source and configured to decelerate and output a rotational output received from the first drive source;

a second speed reducer disposed coaxially with the second drive source and configured to decelerate and output a rotational output received from the second drive source; and a fixing base fixing the first speed reducer and the second speed reducer so as to be arranged in parallel, wherein the first link is fixed to an output unit of the first speed reducer, and the slide guide is fixed to an output unit of the second speed reducer.

3. The tool moving device according to claim 1, wherein the tool holder is configured to hold the tool having a roller shape so as to be rotatable about a rotation axis parallel to the rotation axis of the first link.

4. The tool moving device according to claim 2, wherein the tool holder is configured to hold the tool having a roller shape so as to be rotatable about a rotation axis parallel to the rotation axis of the first link.

5. The tool moving device according to claim 3, wherein the tool holder is disposed coaxially with a rotation center of a disk portion rotatably connecting the slider and the second link.

6. The tool moving device according to claim 4, wherein the tool holder is disposed coaxially with a rotation center of a disk portion rotatably connecting the slider and the second link.

7. A wire forming machine configured to bend a linear wire having a certain length to form a U-shaped body that becomes a part of a coil of a motor, the wire forming machine comprising:

the tool moving device according to claim 1;

a wire feeding device including a quill configured to guide the wire, the wire feeding device being configured to feed the wire from a tip of the quill in a direction perpendicular to the rotation axis of the first link; and a control unit configured to control the first drive source and the second drive source in order for the tool to press and bend the wire extending from the tip of the quill from a side.

8. A wire forming machine configured to bend a linear wire having a certain length to form a U-shaped body that becomes a part of a coil of a motor, the wire forming machine comprising:

the tool moving device according to claim 2;

a wire feeding device including a quill configured to guide the wire, the wire feeding device being configured to feed the wire from a tip of the quill in a direction perpendicular to the rotation axis of the first link; and a control unit configured to control the first drive source and the second drive source in order for the tool to press and bend the wire extending from the tip of the quill from a side.

9. A wire forming machine configured to bend a linear wire having a certain length to form a U-shaped body that becomes a part of a coil of a motor, the wire forming machine comprising:

the tool moving device according to claim 3;

a wire feeding device including a quill configured to guide the wire, the wire feeding device being configured to feed the wire from a tip of the quill in a direction perpendicular to the rotation axis of the first link; and a control unit configured to control the first drive source and the second drive source in order for the tool to press and bend the wire extending from the tip of the quill from a side.

10. A wire forming machine configured to bend a linear wire having a certain length to form a U-shaped body that becomes a part of a coil of a motor, the wire forming machine comprising:

the tool moving device according to claim 4;

a wire feeding device including a quill configured to guide the wire, the wire feeding device being configured to feed the wire from a tip of the quill in a direction perpendicular to the rotation axis of the first link; and a control unit configured to control the first drive source and the second drive source in order for the tool to press and bend the wire extending from the tip of the quill from a side.

11. A wire forming machine configured to bend a linear wire having a certain length to form a U-shaped body that becomes a part of a coil of a motor, the wire forming machine comprising:

the tool moving device according to claim 5;

a wire feeding device including a quill configured to guide the wire, the wire feeding device being configured to be capable of feed the wire from a tip of the quill in a direction perpendicular to the rotation axis of the first link; and a control unit configured to control the first drive source and the second drive source in order for the tool to press and bend the wire extending from the tip of the quill from a side.

12. A wire forming machine configured to bend a linear wire having a certain length to form a U-shaped body that becomes a part of a coil of a motor, the wire forming machine comprising:

the tool moving device according to claim 6;

a wire feeding device including a quill configured to guide the wire, the wire feeding device being configured to feed the wire from a tip of the quill in a direction perpendicular to the rotation axis of the first link; and a control unit configured to control the first drive source and the second drive source in order for the tool to press and bend the wire extending from the tip of the quill from a side.

* * * * *